US005304442A

United States Patent [19]

Murakami et al.

[11] Patent Number: 5,304,442

[45] Date of Patent: Apr. 19, 1994

[54] METHOD FOR ELECTROPHOTOGRAPHIC IMAGE FORMATION

[75] Inventors: Hajime Murakami, Kusatsu; Mizuho Okada, Moriyama, both of Japan

[73] Assignee: Ishihara Sangyo Kaisha, Ltd.

[21] Appl. No.: 960,306

[22] Filed: Oct. 13, 1992

Related U.S. Application Data

[63] Continuation of Ser. No. 560,742, Jul. 31, 1990, abandoned.

[30] Foreign Application Priority Data

Aug. 2, 1989 [JP] Japan ..... 1-200900

[51] Int. Cl.[5] ..... G03G 15/01

[52] U.S. Cl. ..... 430/45; 355/214

[58] Field of Search ..... 430/30, 42, 45; 355/208, 214, 216, 246

[56] References Cited

U.S. PATENT DOCUMENTS

| | | | |
|---|---|---|---|
| 4,390,265 | 6/1983 | Suzuki et al. | 355/140 |
| 4,870,460 | 9/1989 | Harada et al. | 355/246 |
| 4,888,618 | 12/1989 | Ishikawa | 355/208 |
| 4,910,555 | 3/1990 | Namikawa et al. | 355/214 |

FOREIGN PATENT DOCUMENTS

| | | |
|---|---|---|
| 0004572 | 10/1979 | European Pat. Off. . |
| 3412268 | 10/1984 | Fed. Rep. of Germany . |
| 57-37356 | 3/1982 | Japan . |
| 60-80872 | 5/1985 | Japan . |
| 63-240568 | 3/1987 | Japan . |
| 63-149659 | 6/1988 | Japan . |
| 61-299201 | 6/1988 | Japan . |
| 2034249 | 6/1980 | United Kingdom . |

*Primary Examiner*—John Goodrow

*Attorney, Agent, or Firm*—Cushman, Darby & Cushman

[57] ABSTRACT

Disclosed is a method of electrophotographic image formation according to which images of high quality can be reproduced with always stable density. This method which includes the step of image formation which comprises forming a static latent image on a photoreceptor by carrying out charging and exposing and then developing is characterized in that maximum image density is maintained constant by measuring surface potential of maximum image density portion just before development and setting developing bias potential based on the above measured surface potential so that difference between the surface potential and developing bias potential becomes constant.

11 Claims, No Drawings

METHOD FOR ELECTROPHOTOGRAPHIC IMAGE FORMATION

This is a continuation of application Ser. No. 07/560,742, filed on Jul. 31, 1990, now abandoned.

BACKGROUND OF THE INVENTION

The present invention relates to a method of electrophotographic image formation and in particular to a method of electrophotographic image formation according to which images of high quality can be always stable reproduction with desirable density.

Hitherto, there have been well known so-called CPC system which comprises carrying out charging and exposing to form a static latent image on photoreceptor and then developing the latent image to directly form a toner image on the photoreceptor and so-called PPC system by which the toner image formed on photoreceptor by development is transferred onto a plain paper.

Furthermore, in the field of printing in which a half-tone film is made by color separation of original and this is used as a printing plate or information obtained by color separation of original is converted to digital signal, which is directly used as a printing plate, usually various quality tests (control) are conducted using a proof print which approximates to print before printing and it has been studied to utilize rapid and inexpensive electrophotographic process for this proof.

In such electrophotographic process, since electric charge of static latent image subtlely changes depending on environmental conditions such as temperature or humidity, color reproducibility is influenced by the environmental conditions even under the same setting conditions, therefore so adjustment by skilled workers in each necessary occasion and by complete air conditioning, or adjustment must be made by complicated control device. Thus, operation, device or apparatus become complicated.

Moreover, in the field of printing, the print must be the same as or approximate with appearance of commercial articles rather than be faithful to original image and there is the tendency to attach importance to artistic property and severer accuracy is demanded also in balance of density. Therefore, in this field, in order to make it more close to print, various efforts have been made in an attempt to satisfy the severe conditions, for example, method of control of quality called ink proofing has been employed for a long time, and thus time has been spent or expensive materials or apparatuses have been used.

For obtaining images in good balance without fogging of image density or insufficient density by electrophotographic process, a method has been known as disclosed in Japanese Patent Kokai No. 63-149659.

The method disclosed in Japanese Patent Kokai No. 63-149659 is a method for formation of color images by subjecting a photoreceptor to a step including charging, exposing the photoreceptor to form an electrostatic latent image and development which is repeated a plurality of times, characterized in that charging conditions are set for every time of the step so that difference between surface potential of photoreceptor and developing bias potential at respective development positions by respective developing machines used for development becomes substantially constant.

However, since according to the above method, charging conditions are set and controlled for every step comprising charging, forming of static image and developing so that difference between surface potential of photoreceptor and bias potential becomes constant, desired control cannot be easily performed owing to influence of environmental conditions from charging to developing or charging conditions must be set and controlled with also sensing the change of environmental conditions and considering change of surface potential of photoreceptor caused by the change of environmental conditions. Thus, because of complication of operability and apparatus, there are still many points to be improved. Furthermore, since according to the above method, charging conditions are set and controlled for every one step, this method cannot be applied to monochromatic system and besides, since charging conditions are controlled, it is not easy to set maximum image density for every color.

Under the circumstances, there is strongly demanded a method which utilizes electrophotographic process and is rapid, inexpensive and simple.

As a result of research on electrophotographic process conducted by the inventors for a long time, it has been found that the maximum image density can be maintained constant by measuring surface potential of maximum image density portion just before developing and setting developing bias potential based on the measured surface potential so that difference between the surface potential and developing bias potential is constant. Thus, the present invention has been accomplished.

SUMMARY OF THE INVENTION

The present invention provides the following methods for electrophotographic image formation.

(1) A method for electrophotographic image formation which includes the step of image formation which comprises forming static latent image on a photoreceptor by charging and exposing and then developing, characterized by maintaining maximum image density constant by measuring surface potential of maximum image density portion just before development and setting developing bias potential based on the above measured surface potential so that difference between the surface potential and developing bias potential becomes constant.

(2) A method of the above (1), characterized by repeating the step of image formation a plurality of times to form multicolor image.

(3) A method of the above (1) or (2), characterized by carrying out contact exposure with a half-tone film.

(4) A method of the above (1) or (2), characterized by carrying out scanning exposure based on digital image signal.

(5) A method of the above (4), characterized in that the scanning exposuring is carried out by laser beam.

(6) A method of the above (1)–(5), characterized in that the surface potential of maximum image density portion is surface potential of unexposed portion just before development.

(7) A method of the above (1)–(5), characterized in that the surface potential of maximum image density is minimum surface potential of exposed portion just before development.

(8) A method of the above (1)–(7), characterized in that the surface potential of maximum image density portion just before development is measured by providing a portion the surface potential of which is to be measured on at least a part of the photoreceptor.

(9) A method of the above (1)–(8), characterized in that the photoreceptor comprises a photosensitive layer mainly composed of titanium dioxide.

(10) A method of the above (1)–(9), characterized in that development is carried out using a liquid developer.

(11) A method of the above (1)–(10), characterized in that the method of the above (1)–(10) is applied to color proofing.

According to the method of the present invention, (1) reproducibility of stable color density can be obtained and (2) rapid and economically advantageous control of quality can be carried out by applying to simple color proofing in color printing. That is, irrespective of monocolor image or multicolor image, image of stable color density can be rapidly and inexpensively obtained by a simple method and this is also satisfactory for images in the field of printing which requires severe accuracy.

DESCRIPTION OF THE INVENTION

The maximum density image portion in the present invention is electrostatic latent image formed portion on photoreceptor which corresponds to an area which shows maximum density for each color of toner of cyan, magenta, yellow, and black used in subtractive color process or an area called solid image density in the field of printing. This area is one which is usually required to have the density of the following range measured by color densitometor though it may vary depending on kind of ink, toner and printing machine:

| | |
|---|---|
| Cyan; | 1.60 ± 0.05 |
| Magenta; | 1.45 ± 0.05 |
| Yellow; | 1.00 ± 0.05 |
| Black; | 2.00 ± 0.05 |

The area in original which corresponds to the maximum image density portion on photoreceptor may be provided at one end of the original outside the image area in usual reflecting type electrophotographic process, and in case of half-tone film and digital image signal in the field of printing, at one end outside the image thereof. Since the maximum image density portion just before development is used for setting developing bias potential at the subsequent development by measuring surface potential thereof, it is preferred that the area corresponding to the maximum image density portion should be in at least a part of the end portion of photoreceptor in the direction crossing at right angles with the moving direction of developing device.

In order to measure surface potential of maximum image density portion just before development, the portion the surface potential of which is to be measured is provided at least a part on the photoreceptor. For example, a suitable surface electrometer is provided at the position opposing the maximum image density portion of photoreceptor just before development and when the maximum image density portion of photoreceptor passes the opposing surface electrometer, surface potential of the portion is measured. The thus measured surface potential of the maximum image density portion is used for setting the developing bias potential at the subsequent developing step.

That is, on the basis of relation between difference (V) in surface potential and developing bias potential on photoreceptor previously obtained on respective colors and image density (D), so-called V-D characteristics, developing bias potential is set so that the difference in the surface potential of maximum image density portion and the developing bias potential which have been measured becomes constant as potential for obtaining maximum image density of each color.

For example, in case of producing positive image from positive half-tone film used in the field of printing, surface potential of maximum image density portion to be measured is surface potential of un-exposed portion just before development and developing bias potential is set so that difference between this surface potential and developing bias potential becomes constant as maximum image density at which deposition of toner of that color onto the area corresponding to the maximum image density portion of photoreceptor becomes maximum.

In case of producing positive image from negative half-tone film, reversal development is usually utilized. In this case, since surface potential of maximum image density portion to be measured is minimum surface potential of exposed portion just before development, developing bias potential is set so that difference between the surface potential and developing bias potential becomes constant as maximum image density of that color.

The developing bias potential is set by controlling the electrometer and development electrode, for example, using CPU or look-up table so that potential for obtaining image density necessary for maximum image density portion for each color becomes constant.

In this way, by setting developing bias potential so that difference between surface potential of maximum image density portion and developing bias potential becomes constant, maximum image density can be maintained constant even if original is changed and hence, reproducibility of color density is superior and image of high quality can be rapidly and inexpensively obtained with good operability.

The method of the present invention can be applied to formation of monocolor image by using singly respective toners such as cyan, magenta, yellow, and black, but it is more effective for formation of multicolor image by repeating two or more times the image formation step according to subtractive color mixture process.

Furthermore, the method of the present invention can be applied not only to ordinary electrophotographic process comprising subjecting an original to scanning exposure or static exposure, but also to color proofing which includes contact exposure using half-tone film or scanning exposure with beams such as laser beam directly based on digital image signal and especially it is optimum for color proofing which requires severe accuracy in color density. Half-tone film or digital image signal used for the color proofing may be either a positive film or a digital image signal corresponding to positive film or a negative film or a digital image signal corresponding to negative film and in the case of negative film or digital image signal corresponding to negative film, so-called reversal development is utilized.

In the method of the present invention, use of a photoreceptor comprising a photosensitive layer mainly composed of titanium dioxide is desired from the points of whiteness of background and gradation and in the reversal development process utilized when the half-tone film or the digital image signal is negative film or digital image signal corresponding to the negative film, because titanium dioxide possess bi-charging property, therefore charging in both polarities is possible and so the same toner can be used only with changing porality of charging.

Furthermore, dry toner may be used for development in the method of the present invention, but liquid developer is preferred from the point of image quality such as grainness.

The present invention will be explained further by the following examples.

EXAMPLE

A photoreceptor comprising a photosensitive layer mainly composed of titanium dioxide was used.

An apparatus was used which comprises an exposing stand which fixes a photoreceptor on which a half-tone film can further be fixed, a corona charger, tungsten light source for exposure, a surface electrometer, a liquid developing device, and a voltage controlling device for setting developing bias potential applied to development electrode based on surface potential measured by the surface electrometer.

A photoreceptor was put on an exposing stand in the form of a hollow flat plate which was freely rotatably supported on a shaft and fixed by suction from fine halls of the exposing stand. A corona charger moving at a constant speed was passed over the exposing stand on which photoreceptor was fixed. The corona charger can apply corona voltage to corona wire so that same potential can be optionally applied to shield case and grid wire. While corona charger passed over the exposing stand on which photoreceptor was put, the photoreceptor was subjected to positive corona discharging to apply a constant charge potential.

Then, a half-tone film was provided on the photoreceptor so that image side thereof faced the photosensitive layer and a transparent sheet was put on the film and a pressure was applied thereto to bring the sheet into close contact with the half-tone film. This half-tone film was a half-tone negative made using a lith film by a scanner. Two punched holes were provided at given positions of the half-tone film and the exposing stand had projections at the positions corresponding to the punched holes. Positioning was performed by inserting the projections through the holes. After the half-tone film was set on the photoreceptor, exposure was carried out with white light from tungsten light source provided above the exposing stand. Immediately after the exposure, the half-tone film was removed and the exposing stand with the photoreceptor fixed thereon was rotated 180° on the shaft of the exposing stand so that the surface of photosensitive layer of the photoreceptor faced liquid developing device.

Thereafter, surface potential of maximum image density portion was measured by the surface electrometer immediately before the developing device which was provided at one end of the original outside the image area, that is, the position opposing the maximum image density portion. Based on the surface potential measured, developing bias potential was set so that difference between the surface potential of maximum image density portion necessary for obtaining image density of the maximum image density portion and developing bias potential becomes constant and positive developing bias potential was applied to development electrode. The liquid developing device comprises development electrodes the number of which is that of the necessary colors, a developer tank, a drip tray for developer, and a developer replenisher tank and is provided below the exposing stand in such a manner that it can move to the left and right directions. Respective development electrodes, the developer tank, and the drip tray for developer are provided so that they can also move up and down. Development is conducted with positively charged liquid developer. The developer is supplied to the space between the development electrode and the photoreceptor from the side of the development electrode provided in parallel with the surface of photosensitive layer and with a slight space therebetween. When this developing section passes below the exposing stand having thereon a photoreceptor, development is conducted.

The above-mentioned three steps of charging, exposing and developing were used as one set and the same photoreceptor was subjected to the four sets of this image forming steps for each of yellow color, magenta color, cyan color, and black color in this order to obtain excellent four color proof print image on the photoreceptor.

Surface potential of maximum image density portion, developing bias potential applied to development electrode and difference in potential between the surface potential of maximum image density portion and the developing bias potential were as shown in the following table.

| | Surface potential (V) | Developing bias potential (V) | Difference in potential (V) |
|---|---|---|---|
| Yellow | +90 | +160 | 70 |
| Magenta | +100 | +190 | 90 |
| Cyan | +140 | +210 | 70 |
| Black | +110 | +180 | 70 |

A plurality of the above four color proof print image were prepared by setting developing bias potential in the same manner as above so that difference between surface potential of maximum image density portion and developing bias potential became constant. As a result, four color proof print images were obtained which were all good in reproducibility of color density with showing the same color density for the same color and the same tone.

Composition of developers used above for respective colors and relation between density (D) of maximum image density portion measured by densitometer and difference in potential (V) between the surface potential of maximum image density portion and the developing bias potential were as shown below.

| | | |
|---|---|---|
| (1) Yellow color: 1.00 = 70 V | | |
| Chromofine Yellow 5910 (polyazo type; Dainichiseila Kogyo Co., Ltd.) | 1 | part by weight |
| Plexol 966 (acrylic resin; Rohm & Haas Co.) | 1 | part by weight |
| Charge control agent | 0.01 | part by weight |
| Isoparaffinic solvent | 750 | parts by weight |
| (2) Magenta color: 1.45 = 90 V | | |
| Rionogen Magenta R (quinacridone type; Toyo Ink Mfg. Co., Ltd.) | 1 | part by weight |
| Plexol 966 (acrylic resin; Rohm & Haas Co.) | 1 | part by weight |
| Charge control agent | 0.003 | part by weight |
| Isoparaffinic solvent | 750 | parts by weight |
| (3) Cyan color: 1.60 = 90 V | | |

-continued

| | | |
|---|---|---|
| | Heliogen Blue 7100 (phthalocyanine type; BASF) | 1 part by weight |
| | Plexol 966 (acrylic resin; Rohm & Haas Co.) | 1 part by weight |
| | Charge control agent | 0.003 part by weight |
| | Isoparaffinic solvent | 750 parts by weight |
| (4) | Black color: 2.00 = 70 V | |
| | Carbon black (Columbian Carbon Co.) | 1 part by weight |
| | Plexol 966 (acrylic resin; Rohm & Haas Co.) | 1 part by weight |
| | Charge control agent | 0.005 part by weight |
| | Isoparaffinic solvent | 750 parts by weight |

Furthermore, under different environmental conditions, four color proof print image was produced with controlling in the same manner as above so that difference between potential of maximum image density portion necessary for maximum image density portion and developing bias potential was the same as the difference in potential shown in the above table. As a result, four color proof print images of high quality with good reproducibility of color density were obtained.

According to the method for forming electrophotographic images of the present invention, stable reproduction of color density can be obtained and so this method is suitable for electrophotographic process and especially by applying it to simple color proof in color printing, control of quality can be performed rapidly and economically advantageously. Thus, this method is industrially very useful.

What is claimed is:

1. A method for forming an electrophotographic color image comprising the steps of:

forming a static latent image on a photoreceptor via charging and exposing and then developing, maintaining maximum image density of the toned image constantly via measuring the surface potential of the latent image of the maximum image density portion just before development but after charging and exposing, and setting the developing bias potential based on said measured surface potential so that a difference between said surface potential and a developing bias potential is constant.

2. A method according to claim 1, wherein a multicolor image is formed by repeating the step of image formation a plurality of times.

3. A method according to claim 1 or 2, wherein exposing is carried out by contact exposure with a halftone film.

4. A method according to claim 1 or 2, wherein exposing is carried out by scanning exposure based on digital image signal.

5. A method according to claim 4, wherein the scanning exposuring is carried out by laser beam.

6. A method according to any of claims 1–2, wherein the surface potential of maximum image density portion is surface potential of unexposed portion just before development.

7. A method according to any of claims 1–2, wherein the surface potential of maximum image density is minimum surface potential of exposed portion just before development.

8. A method according to any of claims 1–2, wherein the surface potential of maximum image density portion just before development is measured by providing a portion the surface potential of which is to be measured on at least a part of the photoreceptor.

9. A method according to any of claims 1–2, wherein the photoreceptor comprises a photosensitive layer mainly composed of titanium dioxide.

10. A method according to any of claims 1–2, wherein development is carried out using a liquid developer.

11. A method according to any of claims 1–2, which is applied to color proof.

* * * * *